US008294440B2

(12) United States Patent
Lowe, Jr.

(10) Patent No.: US 8,294,440 B2
(45) Date of Patent: Oct. 23, 2012

(54) VOLTAGE REGULATOR USING DEPLETION MODE PASS DRIVER AND BOOT-STRAPPED, INPUT ISOLATED FLOATING REFERENCE

(76) Inventor: Brian Albert Lowe, Jr., Greer, SC (US)

( * ) Notice: Subject to any disclaimer, the term of this patent is extended or adjusted under 35 U.S.C. 154(b) by 248 days.

(21) Appl. No.: 12/728,211

(22) Filed: Mar. 20, 2010

(65) Prior Publication Data

US 2010/0327834 A1 Dec. 30, 2010

Related U.S. Application Data

(63) Continuation of application No. 61/221,042, filed on Jun. 27, 2009.

(51) Int. Cl.
*G05F 1/00* (2006.01)
*G05F 1/571* (2006.01)

(52) U.S. Cl. ..... 323/273; 323/276

(58) Field of Classification Search ..... 323/273, 323/311–313, 276
See application file for complete search history.

(56) References Cited

U.S. PATENT DOCUMENTS 5,168,175 A 12/1992 Endo
5,274,323 A 12/1993 Dobkin et al.
5,283,514 A * 2/1994 Hayward et al. ..... 323/273
5,506,496 A 4/1996 Wrathall et al.
5,621,307 A * 4/1997 Beggs ..... 323/313
5,625,278 A 4/1997 Thiel et al.
5,736,843 A 4/1998 Amin
5,804,956 A 9/1998 Pulvirenti
6,465,999 B2 * 10/2002 D'Angelo ..... 323/315
6,661,210 B2 * 12/2003 Kimball et al. ..... 323/273
6,806,690 B2 * 10/2004 Xi ..... 323/273
6,954,053 B2 * 10/2005 Gay ..... 323/273
6,989,659 B2 1/2006 Menegoli et al.
7,741,823 B2 * 6/2010 Terry et al. ..... 323/273
7,907,074 B2 * 3/2011 Zanchi et al. ..... 323/273
2004/0008013 A1 * 1/2004 Gay ..... 323/273
2009/0033298 A1 * 2/2009 Kleveland ..... 323/273

OTHER PUBLICATIONS

John H. Roberts, Preeminent Preamp, Audio Amateur, Three-1985, pp. 16,17,20,21.22,23, Edward T. Dell Publisher, Peterborough NH, USA.

(Continued)

*Primary Examiner* — Jue Zhang
(74) *Attorney, Agent, or Firm* — Thomas, Kayden, Horstemeyer & Risley, LLP

(57) ABSTRACT

Multiple embodiments of a linear voltage regulator are described that use a bipolar output transistor to deliver current and a regulated voltage to a load. The bipolar output transistor assures low output impedance providing isolation from load induced noise. A first depletion mode field effect transistor FET drives the output transistor dependent on a correction signal from an error amplifier. The error amplifier compares a fixed voltage reference to a portion of the output voltage to set a control voltage for the FET gate. Output voltage is set with an offset voltage referenced to circuit ground and can be generated with a single resistor to circuit ground by a current through the resistor which is set from VREF and the regulated output voltage. Output current is limited with a second depletion mode FET that senses the difference in regulator output voltage and voltage at said first FET transistor drain. All circuitry except the output transistor and 2 FET drivers are bootstrap powered from the regulated output voltage to isolate almost all circuit elements from noise present on the input power source.

13 Claims, 9 Drawing Sheets

OTHER PUBLICATIONS

Bob Pease, What's All This Ripple Rejection Stuff, Anyhow?, Electronic Design Feb. 4, 2002, http://electronicdesign.com/Articles/Print.cfm?ArticleID=1509.

Walt Jung, Low-Noise Power for Analog Circuits, Electronic Design Analog Applications Issue Jun. 23, 1997 pp. 65-68.

Walt Jung, Improved Positive/Negative Regulators, Audio Electronics Apr. 2000 pp. 8-18.

* cited by examiner

VOLTAGE REGULATOR USING DEPLETION MODE PASS DRIVER AND BOOT-STRAPPED, INPUT ISOLATED FLOATING REFERENCE

CROSS-REFERENCE TO RELATED APPLICATIONS

This application is a continuation of application No. 61/221,042 filed on Jun. 27, 2009.

FEDERALLY SPONSORED RESEARCH

Not Applicable

SEQUENCE LISTING OR PROGRAM

Not Applicable

BACKGROUND

1. Field of the Invention

The described invention relates to electronic systems, more specifically to linear voltage regulation using analog circuits, either discrete, integrated or a combination thereof.

2. Description of Related Art

Advances in electronic circuits have brought requirements for lower voltages yet higher resolution, for example audio circuits may attempt to resolve one part in $2^{19}$ over a 0V to 5V full scale span, which is an attempt to resolve ones of micro-Volts. Circuits such as these demand an extremely stable and quiet power supply voltage. Linear voltage regulators are used to provide power to electronic circuits in the form of a constant, stable DC voltage. Various regulator circuits have been created to variously improve line and load regulation and decrease power consumption, so as to provide inexpensive and convenient devices with as few as 2 and 3 terminal connections. Voltage regulators exist as either shunt regulators or series pass regulators, with series pass regulators being the more widely used type due to their higher efficiency. Series pass regulators use feedback as provided by an error amplifier that detects and corrects differences between a ratiometric portion of the output voltage and a fixed, constant voltage reference.

As is well known to those skilled in the art, voltage regulators function as a means to generate a fixed, stable DC output voltage VOUT from a higher and less stable source voltage VIN. Linear voltage regulators typically use a reference voltage and a scaling factor to create the output voltage. Voltage regulators dissipate power as current out times (input voltage -output voltage) and in general it is desired to dissipate the least power possible. Given that the output voltage and current are set by requirements of a load circuit external to the regulator, the only way to minimize power dissipation is to have VIN as close as possible to VOUT while still maintaining regulation. Voltage regulators that continue to regulate with a small difference between VIN and VOUT are known as low drop out regulators. Drop out is defined as the minimum voltage differential VIN-VOUT in which the circuit continues to operate correctly.

Another desired characteristic of voltage regulators is the rejection of unwanted perturbations, generally called noise, that may appear as part of the input voltage. This is called line rejection or line regulation. A third desired characteristic is the rejection of noise on the output voltage due to the electrical demands of the load, known as load regulation. Other naturally desirable characteristics of any electronic circuit are a low parts count, low cost, high reliability and potential use in a wide variety of situations.

Series pass regulators typically use a field effect transistor, known by the acronym FET, or a bipolar transistor series pass element to provide output voltage and current. Sufficient output current can be delivered via the FET source or drain and the bipolar emitter or collector. Delivering output current via the FET drain is known as common source configuration, and via the bipolar collector as common emitter configuration. Common source and common emitter configurations can function with a dropout voltage that depends, for the FET, only on the channel on resistance and, for the bipolar, on the saturation voltage that can reach as low as a few tenths of a volt. The trade off for this low drop out voltage is a relatively high output impedance, resulting in relatively poor load regulation.

Delivering output current via the FET source is known as source follower configuration. Delivering output current via the bipolar emitter is known as emitter follower configuration. Source and emitter follower configurations require a minimum voltage of the FET threshold or the bipolar VBE plus the voltage across the FET drain-source or bipolar collector-emitter. This results in a higher drop out voltage than the common source and common emitter configurations. A discussion of the advantages and disadvantages of various output configurations can be found in the article by Jung, Walt, "Low-Dropout Regulators", published by Analog Devices Inc., no date.

The lower the output impedance of a voltage regulator, the better the load regulation. Emitter follower and source follower configurations are the lowest impedance configurations available, with the bipolar device the clear winner at approximately 10 times lower output impedance versus the FET for equivalent geometric area devices delivering the same current. A bipolar output regulator using an emitter follower output yet with the drop out voltage of the common collector configuration is highly desirable.

Known means exist in prior art for improving line rejection by using the regulated output voltage as power for some internal portions of a regulator such as a reference circuit or difference amplifier. A circuit that supplies power to itself is known in the trade as bootstrapped. Any portion of a regulator powered by VIN is subject to passing some portion of unwanted noise from VIN to VOUT. The more internal elements of a regulator that can be bootstrapped, the better the line regulation. Some prior art that uses bootstrapping has start up problems in which the output voltage may never reach the desired and designed value.

Many prior art voltage regulator circuits exist in individual form and also in integrated circuit form. These circuits employ various techniques to increase line and load rejection, decrease noise and improve dynamic performance. Often these circuits offer a compromise between one performance characteristic and another. For example, low dropout regulators often use a series pass element in common emitter configuration with bipolar transistors [U.S. Pat. No. 5,274,323, Dobkin et al.] and in common source configuration with metal oxide semiconductor field effect transistors (MOSFET) [U.S. Pat. No. 6,373,233 B2 Bakker et al.].

A depletion mode FET has been used in a source follower configuration as series pass element to provide low dropout [U.S. Pat. Nos. 6,989,659 Menegoli et al. and 5168175 Endo], but the disadvantage of the FET output impedance remains. The impedance is substantially 10 times higher than that of an equivalently sized bipolar device. The Menegoli circuit also has a control device in series with the pass device which increases the overall output impedance, and while the power source for the error amplifier is not specified, the remaining control circuitry is powered by the potentially noisy input power supply.

FIG. 1, from Roberts, John H., "Preeminent Preamp", *The Audio Amateur,* 3/1985, contains a schematic diagram of a prior art circuit that is bootstrapped, deriving the power for much of its internal circuitry from the regulated output rather than from the unregulated input. Using the regulated output voltage provides the advantage of isolating the reference and its associated circuitry from any noise present on the unregulated input voltage, noise being defined as any signal deviant from a perfect DC voltage. The Roberts circuit requires both a positive and a negative input and output voltage, thus cannot be simplified into a single supply circuit. Also VOUT (pos) and VOUT (neg) are the reference nodes for their opposite polarity outputs, allowing load induced transients from one polarity output to affect the other polarity output.

Prior art in FIG. 2 illustrates another bootstrapped circuit with error amplifier A1 and reference REF1 powered by the output signal. This circuit uses a zener diode to drop the voltage level at the output of A1 to a value within the power supply range of the amplifier, that is, less than VOUT. An article describing this circuit [Jung, Walt "Improved Positive/Negative Regulators", *Audio Electronics,* 4/2000] notes problems with circuit startup, wherein the circuit has a valid stable state that does not yield the desired VOUT. FIG. 2 requires two resistors and a diode to generate a VIN referred bias current to control the output device. Modification of VOUT in FIG. 2 requires a change to either R1 or R2, which changes the loop bandwidth, adversely affecting load regulation. Another prior art using a bootstrap power supply for some portion of a voltage regulator is seen in U.S. Pat. No. 6,198,266 B1, Mercer, 3/2001.

Reliability of voltage regulators is very important, and a common circuit known as a fold-back current limit is described in "New Developments in IC Voltage Regulators", Robert J. Widlar, *IEEE J. Solid-State Circuits*, vol. SC-6, pp. 2-7, February 1971. Fold-back current limiting uses a sense resistor in the path between regulator output and load to sense the current delivered by the regulator and limit the output current to a value that will prevent destruction of the regulator due to heat from excessive power dissipation. However, use of a fold-back sense resistor increases the output impedance of the regulator.

Thus a voltage regulator is desirable that provides high line and load rejection, low output impedance, low drop out, low device count, simple architecture, flexible usage, can be manufactured with discrete devices or in integrated form, has wide VOUT range that can be varied by changing a single component, with a means to limit output current without increasing output impedance.

SUMMARY OF THE INVENTION

The present invention provides a low dropout regulator with high line and load regulation and widely adjustable output voltage, low output impedance and output current limiting using a simple low element count architecture with floating reference and error correction elements, with output voltage value set via a single circuit element, and error loop bandwidth independent of output voltage.

DRAWINGS

Figures

DESCRIPTION

Figure 1:
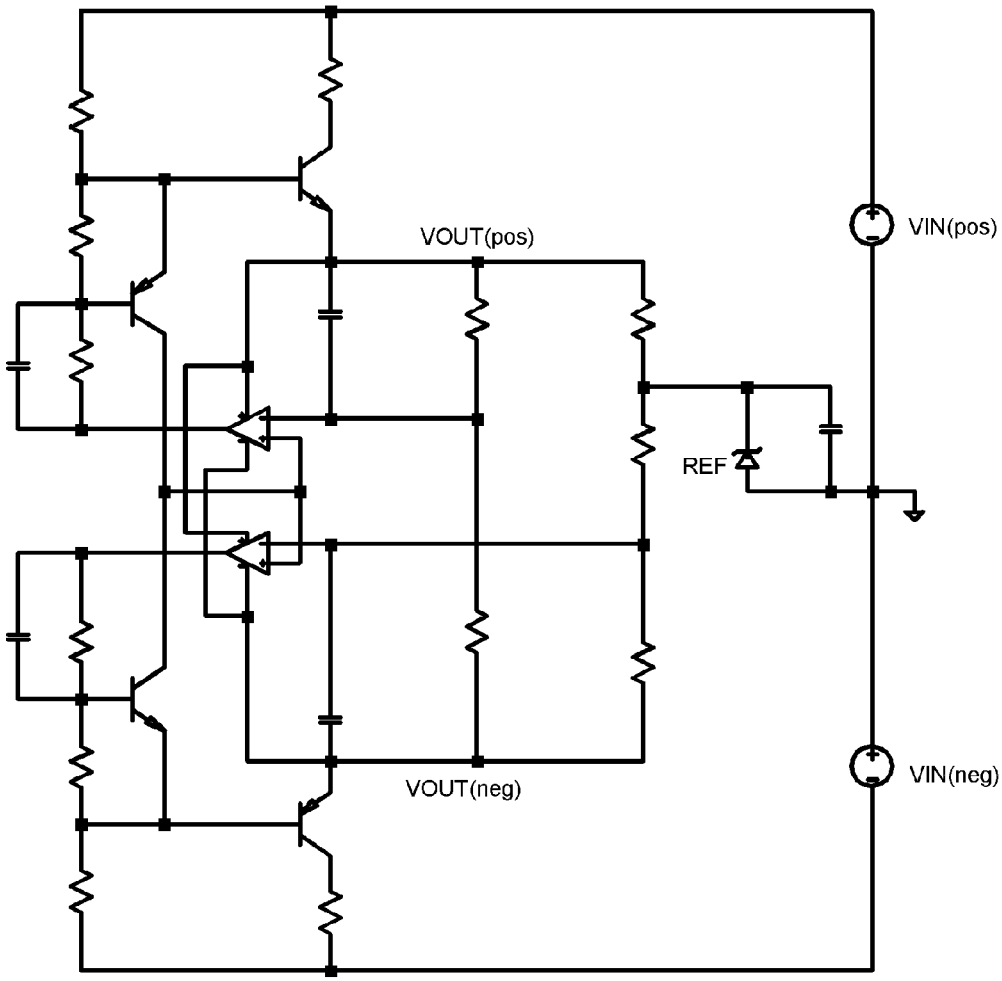
(PRIOR ART) FIGURE 1
FIG. 1 shows prior art of a voltage regulator with bootstrapped power to a portion of its circuitry.
Figure 2:
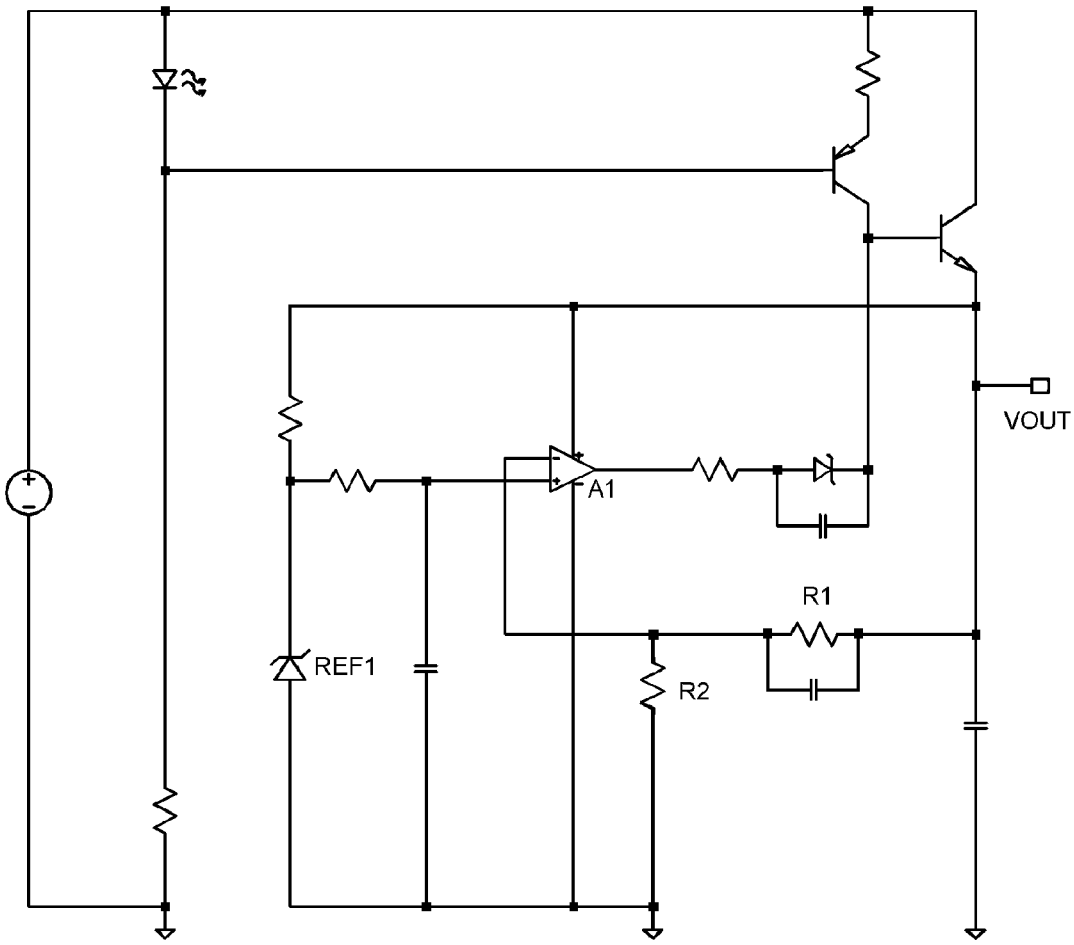
(PRIOR ART) FIGURE2
FIG. 2 shows prior art of a voltage regulator with ground referenced bootstrapped power to a portion of its circuitry, using a zener diode to allow an error amplifier to operate within its power supply range.
Figure 3:
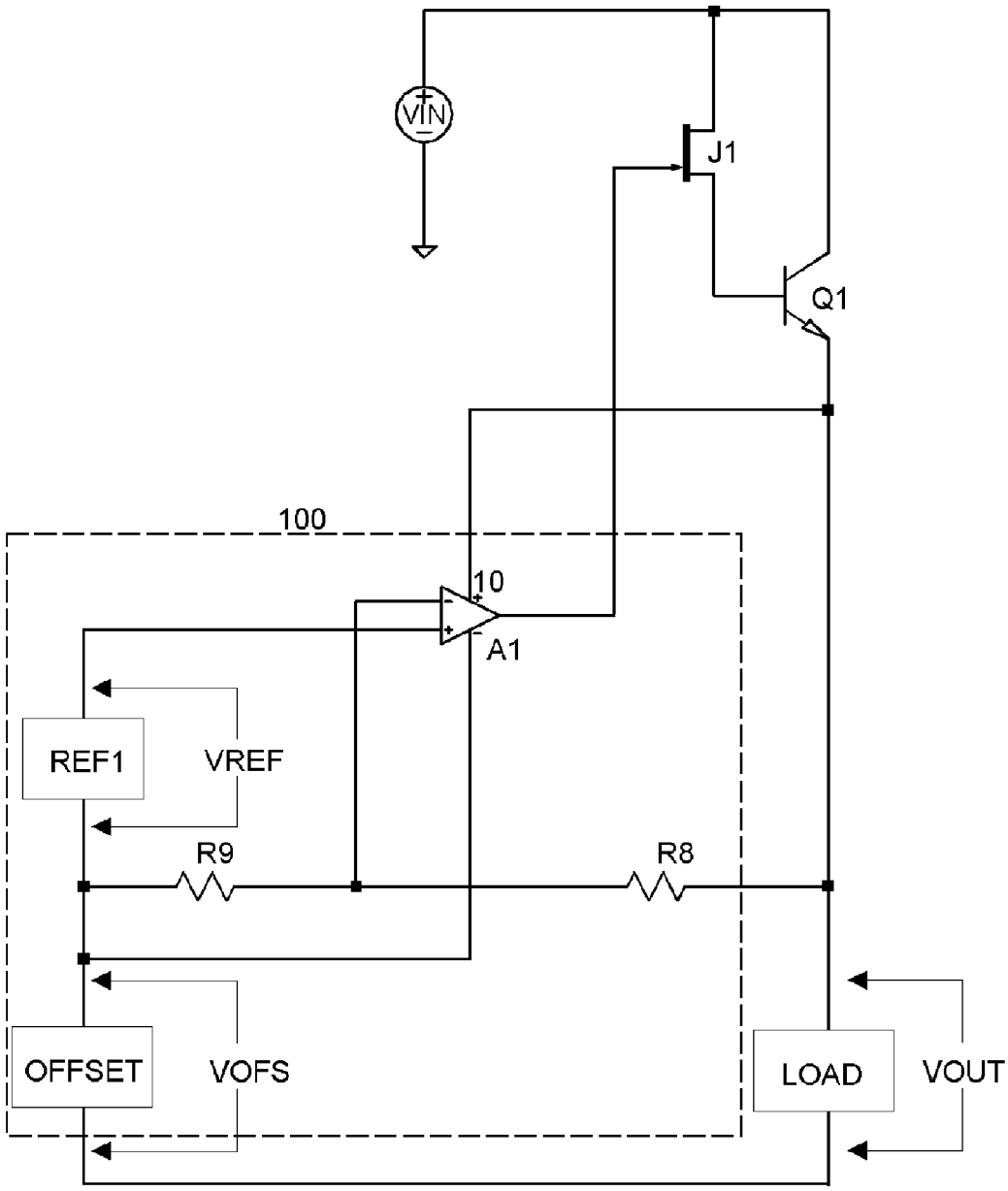
FIG. 3 shows a simplified primary embodiment of the present invention, with floating reference and error amplifier.
Figure 4:
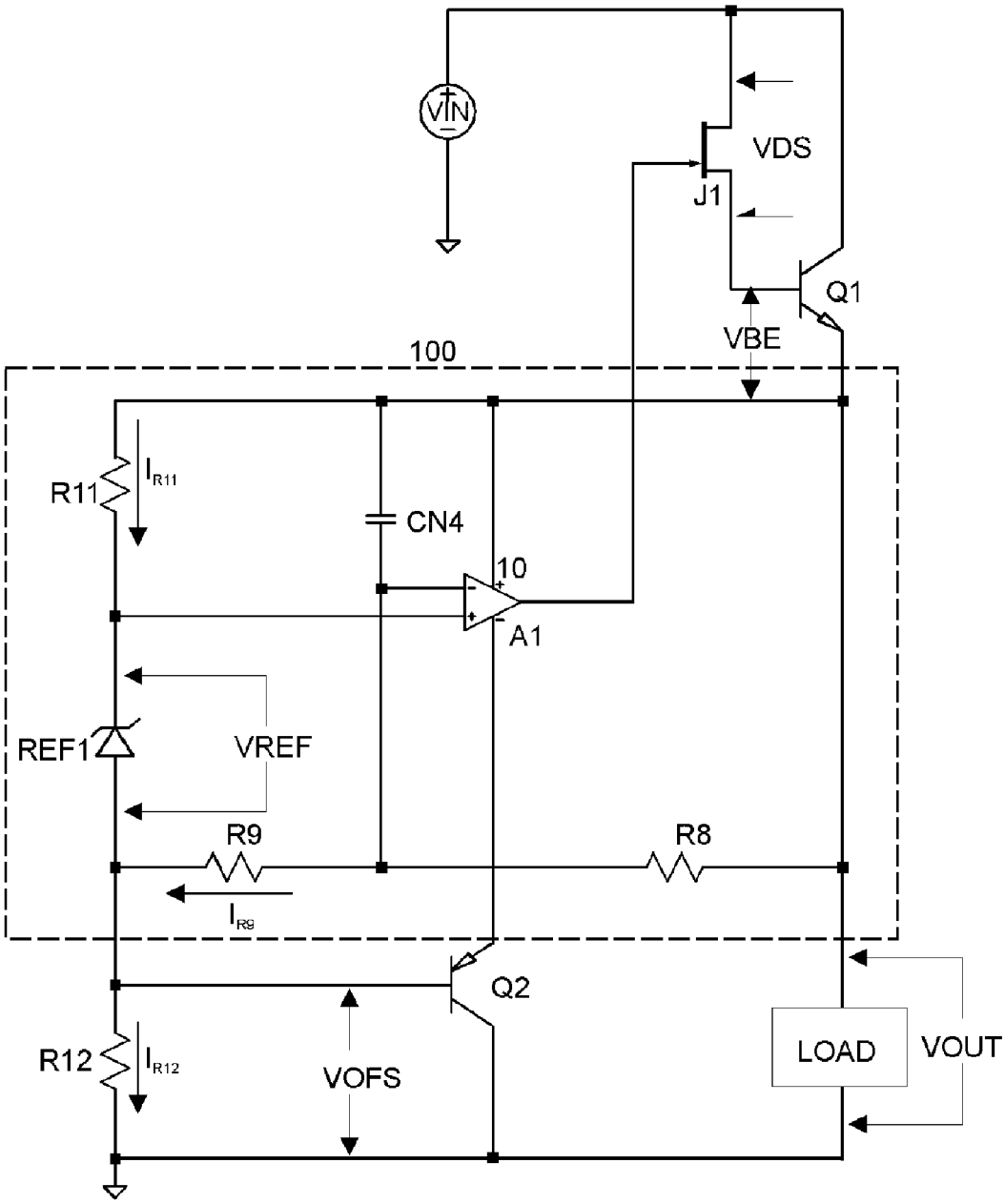
FIG. 4 is a detailed primary embodiment of the present invention, with floating reference and error amplifier, having adjustable output voltage by modifying the value of a single resistor.

FIGS. 3 and 4

Preferred Embodiment

The described invention uses a novel circuit configuration of standard devices to provide a voltage regulator with low output impedance, low dropout voltage, high line and load rejection. The invention can be assembled using existing individual circuit components or can be designed as a single integrated circuit. It can deliver any regulated output voltage value with a change in a single component, with constant loop bandwidth and no substantial difference in performance for one output voltage versus another. The invention makes use of a characteristic of depletion mode field effect transistors (FET) in which current is conducted when the gate voltage equals the source voltage (VGS=0) and current is gradually cut off as gate voltage decreases below (for N channel FET) or increases above (for P channel FET) the source voltage.

The embodiment of FIG. 3 comprises a reference voltage device REF1, an error amplifier A1, a feedback network R8 plus R9, an offset voltage generator OFFSET, a load network LOAD, an N channel junction field effect driver transistor J1 and an NPN bipolar output transistor Q1. All sections denoted by block 100 are powered by the output voltage from the emitter of Q1, giving the block a fixed and stable self-generated bootstrapped voltage source. The bootstrapped supply isolates the entire circuit excepting the two output devices J1 and Q1 from electrical noise on the VIN supply to provide high line regulation. The combination of REF1, A1, J1, Q1, R8 and R9 create a feedback loop to provide high load regulation for VOUT.

The present invention will always start with correct output voltage because, prior to power applied at VIN , VOUT and the gate voltage of J1 are initially at the same voltage and J1 acts as a linear resistance. When VIN increases as input power is applied, current flows through the drain and source of J1 and into the base of Q1 causing current into LOAD via Q1 emitter, increasing VOUT and pulling control circuit block 100 up by its bootstraps. In the case when the LOAD impedance is infinite, the current required by the circuit elements within block 100 constitute an internal load that bootstraps itself.

J1 is a voltage follower of the output voltage of amplifier A1 and provides base current for Q1. In operation, J1 gate voltage is pulled lower than J1 source voltage by A1 as it nulls the difference around the feedback loop comprised of J1, Q1 and R8. The decrease in J1 gate voltage limits current into Q1 base as the control loop approaches equilibrium. By choosing or designing J1 to have a gate pinch-off voltage Vp of magnitude sufficient to pull error amplifier A1's output below its power supply voltage at node 10, output voltage VOUT reaches a designed value dependent on the voltage VREF of REF1, an offset voltage VOFS and the ratio of R8/R9 as given by the following equation:

$$VOUT=(VREF*(1+R8/R9))+VOFS$$

In the simplest case, VOFS can be zero volts and VOUT is set as $$VOUT=VREF*(1+R8/R9)$$

VREF can be generated from a zener or avalanche diode, a band gap reference, a buried zener reference or any other means to generate a fixed reference voltage appropriate to the power supply levels required by A1 and by the desired VOUT.

FIG. 4 is a more detailed embodiment of FIG. 3. Here, FIG. 3's OFFSET element has been replaced by a resistor. PNP emitter follower transistor Q2 has been added to shunt current from the negative supply rail of A1 away from R12. The following analysis ignores the current into the input terminals of error amplifier A1 and the base of Q2 because they are orders of magnitude less than the current through R11, REF1 and R12. VOFS is set by the current through resistor R12 as $$VOFS=I_{R11}*R12$$

Current through R12 is the sum of currents through resistors R11 and R9. Analysis reveals that the voltage across R11=VOUT-VREF and it can be algebraically deduced from the VOUT equation above that the current $I_{R11}$ through R11 is a fixed value given by $$I_{R11}=(VREF*(R8/R9))/R11$$

and the current $I_{R9}$ through R9 is a fixed value given by $$I_{R9}=VREF/R9$$

With a constant known current of $I_{R12}=I_{R9}+I_{R11}$, VOUT can be set to any value below the input voltage VIN minus the dropout voltage of J1 and Q1 by adjusting the value of R12, with the condition that VOUT must be high enough to power A1 and REF1. The circuit comprised of block 100 in FIG. 4 floats at VOFS above a ground reference level, providing output voltage $$VOUT=VOUTZ+VOFS$$

where $$VOUTZ=VREF*(1+R8/R9)$$

as given in the simplest case above and $$VOFS=(VREF*R12/R9)(1+R8/R11)$$

based on the equations for $I_{R11}$ and $I_{R9}$. With block 100 floating between VOUT and VOFS, only R12 and Q2 need to withstand a high voltage level in the case where VOUT is a large value, allowing most of the circuit to be built from less expensive low voltage elements.

The embodiment of FIG. 4 directly connects both Q1 collector and J1 drain to VIN to yield a dropout voltage of J1 drain to source voltage VDS plus Q1 base to emitter voltage VBE. For a low on-resistance J1 and a typical bipolar power transistor Q1 delivering approximately 10 milliAmps into LOAD, dropout voltage VDS+VBE is between 0.5V and 0.6V, reaching 1.1V to 1.3V while delivering approximately 400 milliAmps into LOAD. The embodiment provides the low output impedance of the bipolar output device Q1, with values in the ones of milliOhms range.

Both J1 and Q1 are unity gain followers, allowing dynamic performance and stability to be governed primarily by error amplifier A1. A1 can be comprised of any suitable difference amplifier such as a differential pair, an operational amplifier (op amp) or an output transconductance amplifier. For stable dynamic performance some op amps require a compensation network CN4 as shown in FIG. 4 which consists of a lead (capacitive) network, but can also be a lag lead (resistive and capacitive) network or Miller capacitance. Depending on the amplifier used for A1, the output may require a dominant pole capacitance to ground to guarantee stability for substantially all load impedances. Added capacitance from the gate to the source of J1 may also be employed to enhance stability for some load impedances.

DESCRIPTIONS OF ADDITIONAL EMBODIMENTS

To limit the output current and thus increase the reliability of the invention, the known current limiting means of fold-back current limit discussed in the description of related art can be used. However, to maximize load rejection it is desirable to achieve the lowest possible impedance at the node VOUT. Adding a current sense resistor in series between Q1 emitter and LOAD increases the output impedance by the value of the current sense resistor, which is undesirable.

Adding a resistor between VIN and the drain of J1 is another means to limit Q1 base current, thereby limiting Q1 emitter current to LOAD. This requires a resistance value that depends on the difference in VIN and VOUT , making it difficult to use in a general purpose circuit that can accept a multitude of values for VIN and VOUT.

FIG. 5

Figure 5:
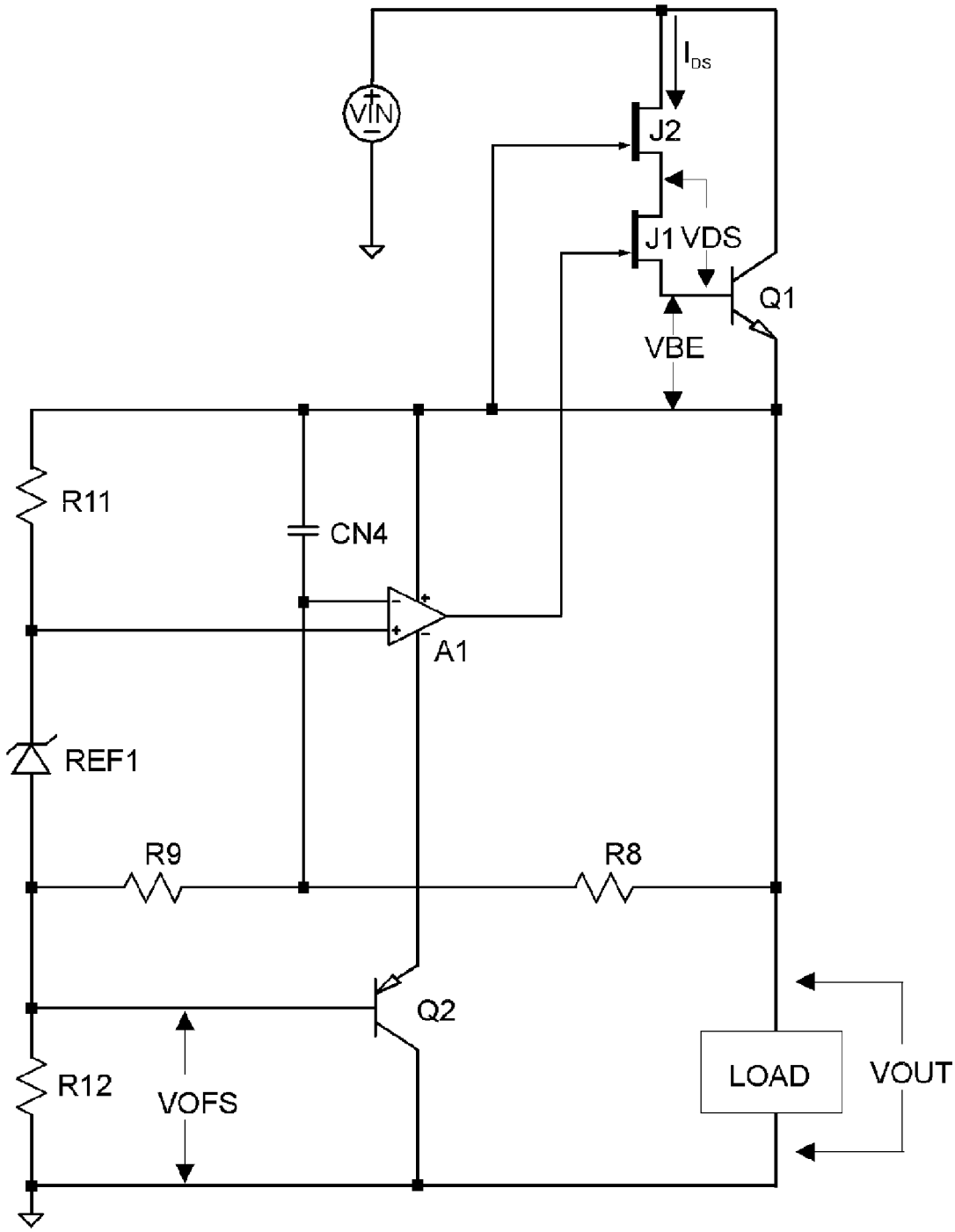
FIG. 5 is an extension of the primary embodiment showing a novel means to limit output current without increasing output impedance.
Figure 6:
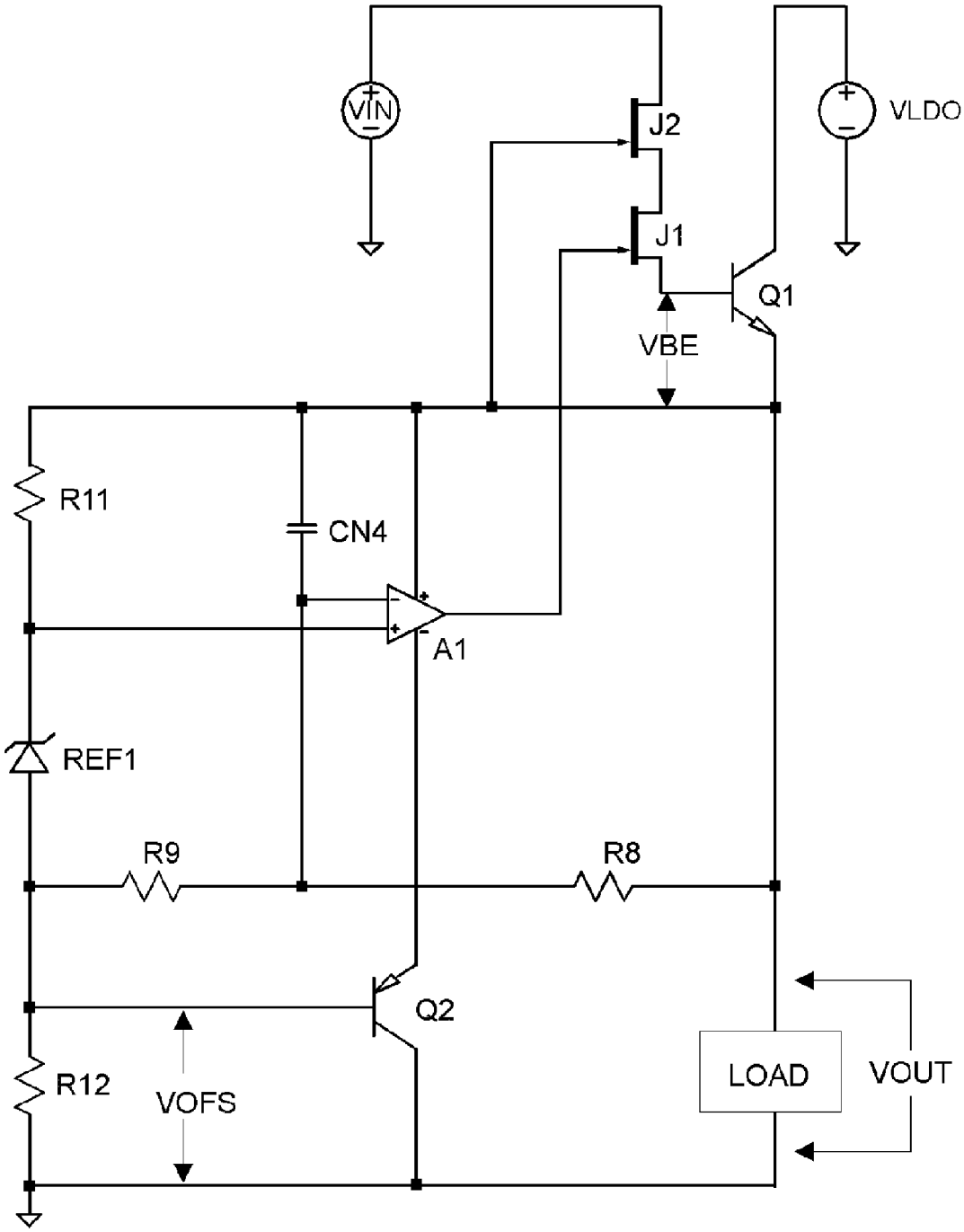
FIG. 6 is an extension of the embodiment of FIG. 5 showing a means to maintain low dropout voltage while allowing output current limit without increasing output impedance.

The embodiment of FIG. 5 limits output current with the addition of a depletion mode FET J2 between VIN and J1. J2 limits output current to a value dependent on the pinch-off voltage of J2, without increasing output impedance. Understanding that negligible current flows through the gates of J1 and J2, the shared source to drain current IDS of J2 and J1 substantially constitutes the base current of Q1. With Q1 emitter output current set as beta times Q1 base current, limiting J1 source current limits output current to LOAD. The limit occurs when J1 VDS+Q1 VBE approaches the VGS pinch off voltage of J2. As Q1 base current increases with increasing LOAD current demand, J1 source current increases, simultaneously increasing J1 VDS and decreasing J2 VGS, moving J2 toward pinch off. Pinch off limits source current of J2 and thus J1, limiting current to Q1 base and thus limiting current to LOAD. The circuit in FIG. 5 allows output current limiting while keeping output impedance equal to the lowest possible value, that of a bipolar emitter follower transistor. It has a disadvantage of increasing the dropout voltage by the VDS of J2, which is small at nominal drain current and can be avoided completely by using a separate power supply at the collector of Q1 as with FIG. 6.

FIG. 6

Use of a separate power supply VLDO provides the benefit of limiting maximum output current with zero additional output impedance as in FIG. 5, plus the benefit of even lower dropout voltage. Q1 collector is powered separately with voltage VLDO which is lower than VIN as shown in the embodiment of the invention in FIG. 6, allowing the dropout voltage of the power delivery device Q1 to approach the saturation voltage of a bipolar transistor, which is on the order of 0.2V to 1V depending on the specific transistor used for Q1 and on the load current.

FIG. 7

Figure 7:
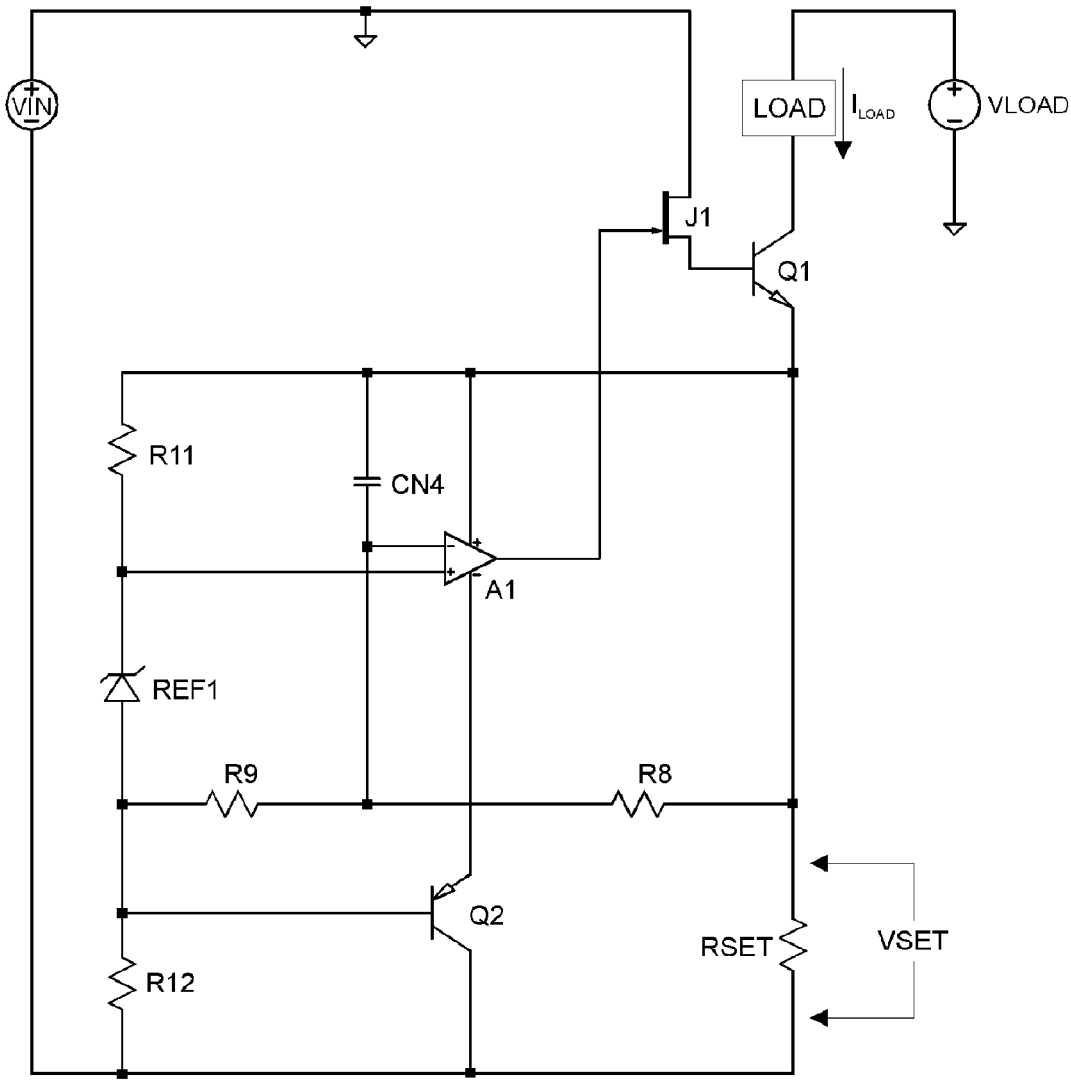
FIG. 7 is an extension of the primary embodiment wherein a constant current is generated from an additional voltage source by using a fixed resistor as a load.

FIG. 7 illustrates an embodiment of the invention whereby the output signal is a precision constant current. The ground reference point is moved to the positive terminal of VIN , LOAD is between ground potential and the collector of Q1, and a fixed value resistor RSET is between VSET and the negative terminal of VIN . $I_{LOAD}$ is calculated as VSET/RSET $-I_{BASE}$ of Q1. VSET is a regulated voltage equivalent to VOUT of FIG. 6 which, when imposed across RSET generates a fixed current from the emitter of Q1. At a fixed emitter current, Q1 base current is also fixed, generating a fixed current through LOAD equal to the difference of Q1 emitter and base currents. An additional voltage source VLOAD with a positive potential referenced to ground is used to supply the fixed current.

FIG. 8

Figure 8:
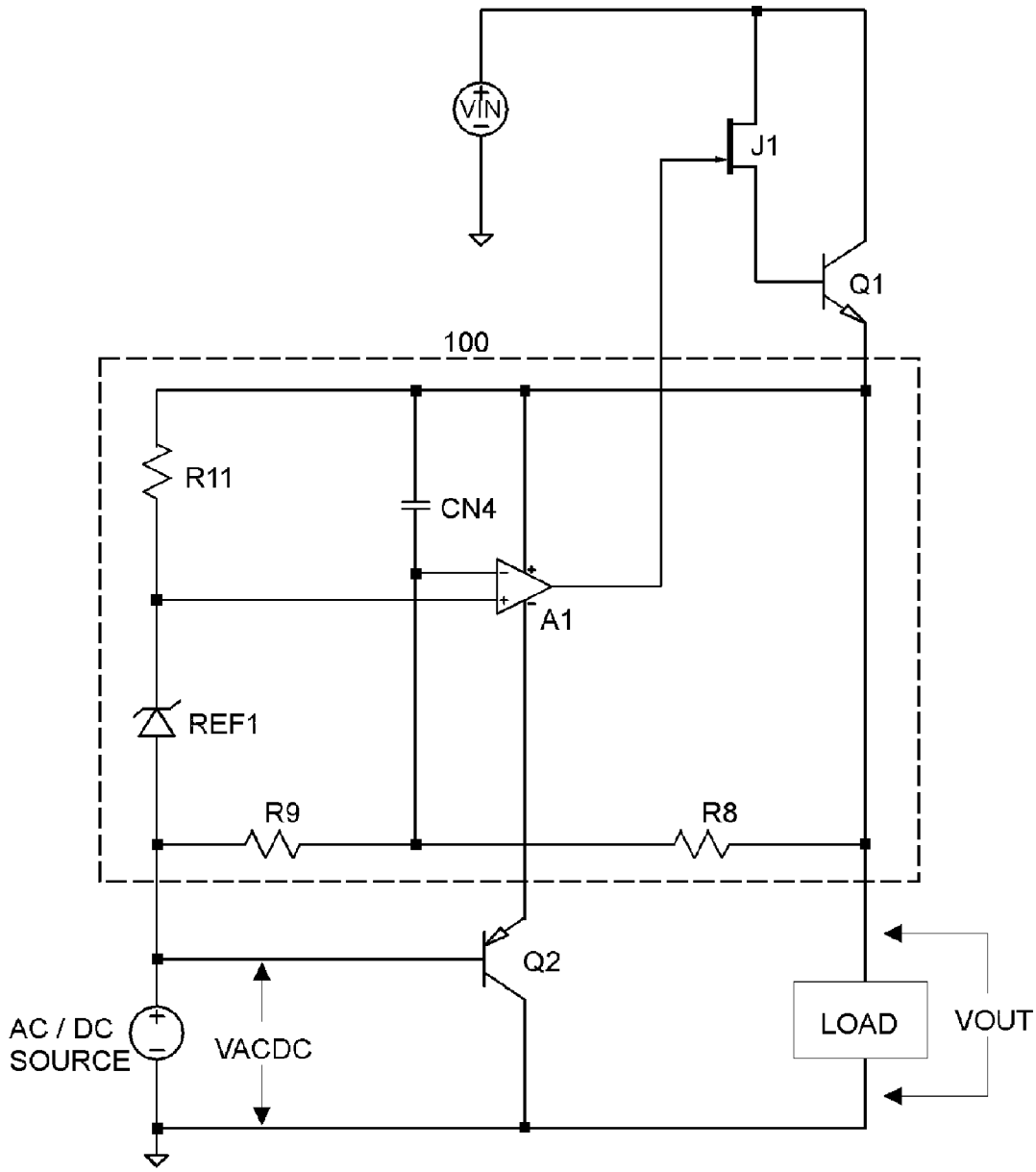
FIG. 8 is an extension of the primary embodiment wherein the output voltage is modulated by a voltage source.

FIG. 8 illustrates an embodiment of the invention whereby the output signal is modulated using an AC signal or a combination of AC and DC as the reference basis, to provide voltage modulated power delivery. The resistor R12 of FIG. 4 is replaced in FIG. 8 by AC/DC SOURCE, which can be AC, DC or a combination of the two. The voltage source then drives the floating reference block 100, such that $$VOUT=(VREF*(1+R8/R9))+VACDC$$

where VOUT is no longer a fixed DC value but a variable value dependent on the value supplied by AC/DC SOURCE.

FIG. 9

Figure 9:
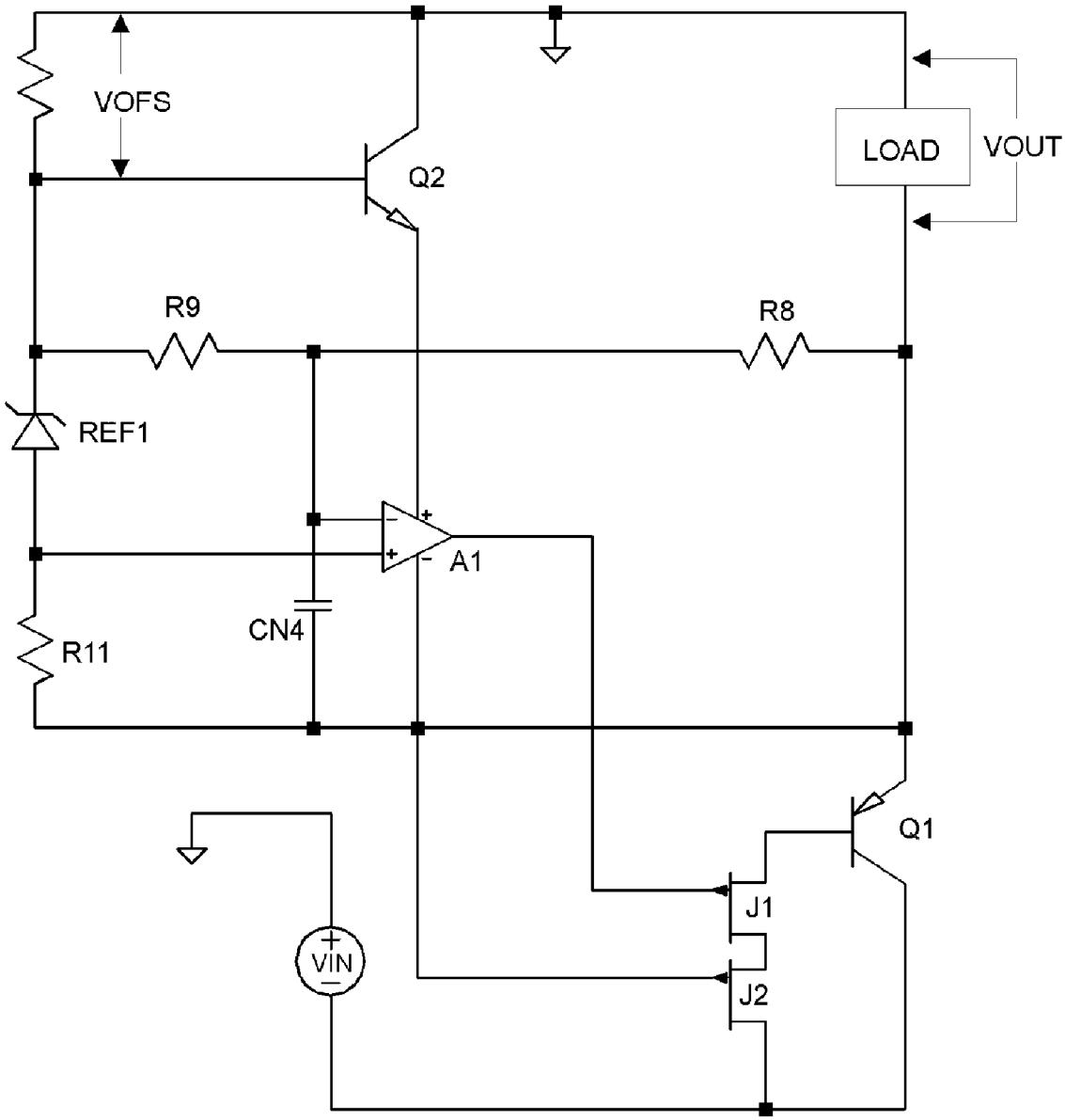
FIG. 9 is a negative output voltage embodiment of the primary embodiment of FIG. 4.

A negative voltage regulator is embodied in FIG. 9 using complementary device types, NPN instead of PNP and PJFET instead of NJFET, with the basic topology and function as described earlier for the positive voltage regulator in FIGS. 4 and 5.

What is claimed is:

1. A voltage regulator circuit comprising:

a regulator input terminal configured to receive power from a regulator input voltage source;

an error amplifier comprising a positive input terminal configured to receive a reference voltage;

a reference voltage circuit comprising a reference voltage output terminal and a reference common terminal, wherein the reference voltage output terminal is connected to the positive input terminal;

an offset voltage circuit configured to supply a voltage offset difference between the reference common terminal and a ground potential terminal;

a regulator output terminal configured to deliver a current to a load at a regulated voltage substantially independent of a plurality of voltage transients on the regulator input voltage source and substantially independent of a plurality of current transients on the regulator output terminal;

a current controlled output transistor (CCOT) comprising:

a first CCOT electrode connected to the regulator input terminal;

a second CCOT electrode connected to the regulator output terminal; and a third CCOT electrode configured to control a voltage at the second CCOT electrode;

a voltage controlled driver transistor (VCDT) comprising:

a first VCDT electrode connected to the regulator input terminal;

a second VCDT electrode connected to the third CCOT electrode; and a third VCDT electrode being configured to control a current from the second CCOT electrode;

an output voltage sensor configured to sense at least a portion of the regulated voltage between the regulator output terminal and the reference common terminal, where a voltage at the output voltage sensor is compared with a voltage at the reference voltage output terminal by the error amplifier, the error amplifier being configured to generate a control signal that is applied to the third VCDT electrode.

2. The circuit of claim 1, wherein the voltage at the third VCDT electrode is less than or equal to the voltage at the second VCDT electrode.

3. The circuit of claim 1, wherein the positive input terminal is connected to the reference voltage output terminal and a negative power supply terminal of the error amplifier is connected to the reference common terminal.

4. The circuit of claim 1, wherein the output voltage sensor comprises a first resistor and a second resistor connected in series, a first electrode of the first resistor connected to the regulator output terminal, a second electrode of the first resistor connected to a first electrode of the second resistor and to a negative input terminal of the error amplifier, and a second electrode of the second resistor connected to the reference common terminal.

5. The circuit of claim 4, wherein an offset voltage circuit output terminal is connected to the second electrode of the second resistor and to the reference common terminal, and an offset voltage circuit reference terminal is connected to the ground potential terminal.

6. The circuit of claim 1, wherein the reference voltage output terminal is connected to the positive input terminal and to a first electrode of a third resistor of the output voltage sensor, the reference common terminal is connected to the offset voltage circuit output terminal, and a second electrode of the third resistor is connected to the regulator output terminal, establishing a fixed current through the reference voltage circuit.

7. The circuit of claim 6, wherein the offset voltage circuit comprises a fourth resistor between the reference common terminal and the ground potential terminal, the fourth resistor being configured to conduct a fixed current, wherein the fixed current is established by a sum of currents through the second resistor and the third resistor.

8. The circuit of claim 1, further comprising a buffer transistor comprising:

a first buffer transistor electrode connected to the negative power supply terminal of the error amplifier;

a second buffer transistor electrode connected to the ground potential terminal; and a third buffer transistor electrode connected to the offset voltage circuit output terminal, the buffer transistor being configured to conduct a negative power supply terminal current to the ground potential terminal.

9. The circuit of claim 8, further comprising a voltage controlled limit transistor (VOLT) configured to limit a current to the regulator output terminal, wherein the (VOLT) comprises a first VOLT electrode connected to the regulator input terminal, a second (VOLT) electrode connected to the first VCDT electrode, wherein the first VCDT electrode is no longer connected to the regulator input terminal, and a third VOLT electrode connected to the regulator output terminal.

10. The circuit of claim 8, wherein the current controlled output transistor is a complementary current controlled output transistor, the voltage controlled driver transistor is a complementary voltage controlled driver transistor, and the buffer transistor is a complementary buffer transistor.

11. The circuit of claim 1, wherein the first CCOT electrode is connected to a low drop out power supply, the low drop out power supply being configured to provide a voltage less than the voltage supplied to the regulator input terminal, wherein the first CCOT electrode is no longer connected to the regulator input terminal.

12. The circuit of claim 1, wherein the first CCOT electrode is connected to a first impedance electrode such that the first CCOT electrode is no longer connected to the regulator input terminal, a second impedance electrode is connected to a voltage source, wherein an impedance comprises a fixed resistance such that a fixed current is delivered to the impedance.

13. The circuit of claim 1, wherein the offset voltage circuit comprises an AC plus DC voltage source, the AC plus DC voltage source being configured to modulate the voltage at the regulator output terminal.

* * * * *